United States Patent [19]

Auge

[11] 4,252,062

[45] Feb. 24, 1981

[54] DIRECTIONAL EFFECT MINE WITH FORMED CHARGE

[75] Inventor: Claude Auge, Bourges, France

[73] Assignee: Direction Technique des Armements Terrestres, Paris, France

[21] Appl. No.: 334,067

[22] Filed: Feb. 12, 1973

[30] Foreign Application Priority Data

Feb. 11, 1972 [FR] France ..... 72 04592

[51] Int. Cl.[3] ..... F42B 23/24

[52] U.S. Cl. ..... 102/8; 102/1 R; 102/24 HC

[58] Field of Search ..... 102/24, 24 HC, 1, 8, 102/70

[56] References Cited

U.S. PATENT DOCUMENTS 2,837,996 6/1958 Klotz ..... 102/24 HC 3,216,354 11/1965 Bearce ..... 102/8

3,495,532 2/1970 Roberts et al. ..... 102/8

*Primary Examiner*—David H. Brown

*Attorney, Agent, or Firm*—Haseltine and Lake

[57] ABSTRACT

A mine of the formed charge type with directional effect and having an overall flat shape so that when in place, it presents an efficient upper surface parallel with the lower surface. An explosive charge is contained in the mine and is limited by a metal liner located close to each of both surfaces of the mine. An initiation system is placed between the two liners so as to be free to move in the explosive charge under the effect of gravity in a direction substantially perpendicular to the surfaces of the mine such that the initiation point of the explosive charge can be positioned near the lower surface of the mine.

10 Claims, 2 Drawing Figures

FIG. 1
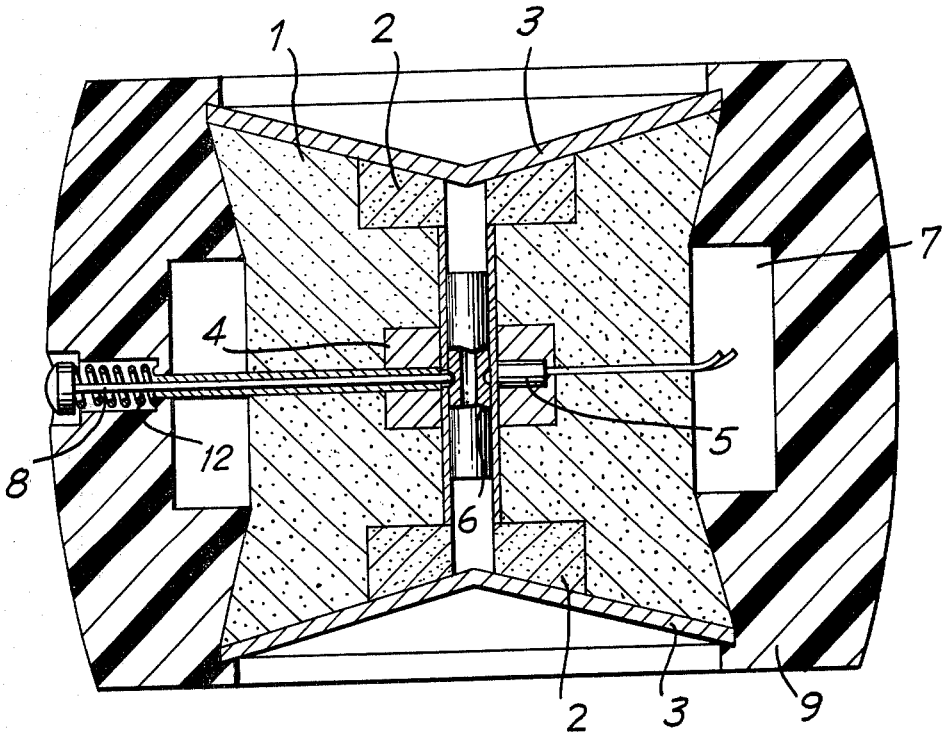
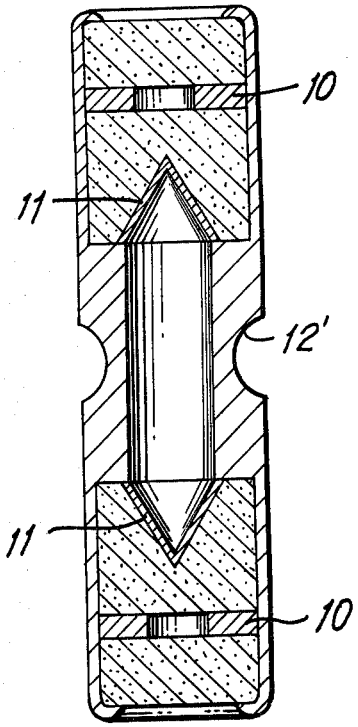
FIG. 2

DIRECTIONAL EFFECT MINE WITH FORMED CHARGE

BACKGROUND (a) Field of the Invention

The present invention relates to a directional effect mine capable of operating in whatever manner it is deposited.

(b) Prior Art

Although a formed charge mine can be considered the most efficient and simplest anti-tank ventral mine, it presents the disadvantage of high directional effect and requires a preferential orientation upon placement; therefore, it is restricted to the use of manual or mechanical operation devices for placement.

The rapid or remote placement (dropping from aircraft or helicopters, or from a projectile containing mines, or throwing from a truck) prevents the use of formed charge mines unless they are provided with special orientation devices such as parachutes, stabilizers, etc. Such devices impose an increase in volume and weight which is detrimental to the charge power and which furthermore adversely affects the mine field and of its laying mode.

SUMMARY OF THE INVENTION

The mine according to the invention can be layed by dropping from a projectile, usually self-powered, but it is also suitable for being dropped from an aircraft, helicopter or for being thrown from any type of vehicle.

Hence, the invention contemplates a mine of the formed charge type, with directional effect according to one of two opposite directions, and capable of operating whatever its laying mode and especially usuable as an anti-tank mine. The mine of the invention is characterized by having an overall shape which is flat, and presents, once in place, an efficient upper flat surface parallel with the lower surface. It also includes an explosive charge limited by a metal lining located close to each of both surfaces of the mine. An actuation system, placed between the two said linings, is free to move in the explosive charge under the effect of gravity in a direction substantially perpendicular to the surfaces of said mine, thus enabling the initiation point of the explosive charge to be positioned near the lower surface of the mine.

Another object of the invention is to provide a mine as described above and characterized in that said explosive charge consists of two formed half-charges whose arrangement is approximately symmetrical with respect to the transverse median plane of said mine. Each half-charge is provided with a metal lining in the part near the mine surfaces. The actuation system is common to both half-charges and rests against the metal lining, and it features a holder containing an explosive which is moved by the effect of gravity in a tube cavity extending along the axis common to both half-charges, thus enabling the initiation point to be positioned near the lower surface of the mine.

Also the invention contemplates a mine such as that described above and characterized in that the holder on the actuation system is movable in opposite directions in said tube and is laterally actuated through high-velocity impact. The holder may also include a detonation alignment device.

The invention further contemplates a mine such as that described above and characterized by a self-contained influence igniter provided with a single pyrotechnical outlet.

Finally, the invention contemplates a mine which includes an explosive incorporating an elastomer binder, preferably polyurethane, and a coating whose chemical composition is similar to that of the binder.

Preferably, the mine according to the invention may be in the shape of a truncated ellipsoid whose ratio of height-to-largest diameter is approximately 0.7 max.

BRIEF DESCRIPTION OF THE DRAWING

FIG. 1 is a cross-sectional view of the mine according to the invention, and FIG. 2 is an enlarged cross-sectional view of the detonator tube of FIG. 1.

DETAILED DESCRIPTION

FIG. 1 shows a mine according to the invention containing explosive charge 1, two primer relays 2 and two linings 3. A detonation wave shaping member 4 is embedded in the charge 1 and it contains an electrical detonator 5. A detonating assembly 6 is centrally disposed in the charge 1. The mine also includes a self-contained influence igniter 7, a removable safety device 8 and a protective cover 9. In the illustrated embodiment, the mine has the general overall shape of a truncated ellipsoid.

As constructed, the mine is comprised of two formed half-charges, each including:

the lining 3 formed as a copper conical member of several millimeters thickness with a vertex of approximately 150° the charge 1 whose explosive composition is made of hexogene (80% in weight) and a polyurethane binder in a proportion of 20% in weight, and the primer relay 2 whose explosive composition is made of 90% hexogene and 10% polyvinyl acetate.

Both half-charges are assembled in opposition to each other and receive the common wave shaping member 4 and the central detonating assembly 6. The assembly 6 consists of:

a tube element *6a* extending through both half-charges, a mobile sliding primer holder *6b* mounted in tube element *6a* with a clearance of approximately 0.2 mm and constituted as a brass tube fitted at each side with a relay charge *6c*, a detonation wave guide 10 with a guide bore therein and a closure member 11 forming a "shaped charge" (see FIG. 2). The wave guide is shown as a washer, but it could also be constructed as a diaphragm or screen to direct the detonation wave towards the closure member 11 such that it is centered on the axis of revolution of the closure member.

The igniter 7 is a conventional multiple influence electronic igniter which surrounds the main explosive charge 1. The igniter 7 transmits a firing signal to the electrical detonator 5 within the member 4.

The cover 9 is constructed as an elastomer polyurethane casing, obtained through potting, and the cover provides protection and mechanical strength of the whole assembly and defines the outer shape of the mine.

The mine operation is as follows:

Before the mine has dropped into place, pin 8 is ejected by the action of a bias spring 12 as for example by release of a restraining cover (not shown) by electrical or pyrotechnical means, or automatically by release of the mine from an enclosing cover or even manually.

Thereby the inner end of pin 8 which had been engaged in recess 12' in holder 6b is retracted and frees holder 6b which then becomes freely mobile in tube element 6a. The dropping of the mine also is accompanied by activation of the electrical circuits of the influence ignition system. The energization of igniter 7 is usually delayed by a duration corresponding to the mine dropping so that the mine will not become activated until it is in place on the ground.

After the mine is stabilized on the ground, the primer holder 6b becomes positioned by gravity, near the lower surface of the mine. The mine is capable of operating up to a maximum inclination of about 45° with respect to the ground. In such position, detonator 5 faces the explosive contained in the upper portion in the holder 6b.

Upon igniter energization, for example, due to the passage of a tank, the electrical detonator 5 is caused to operate. The detonation is laterally transmitted to the detonating assembly 6 and due to alignment by the guide 10, the shock force produced by detonation of the charge in the upper portion of the holder 6b causes rupture of closure member 11 and the shock force is transmitted to the explosive at the opposite portion of the holder 6b. The length of the tube 6a and the holder 6b is such that the explosive, located between guide 10 and the end of the holder 6b faces the detonator 5 in the "clocked" position.

The detonation is then transmitted to that primer relay 2 located in proximity to the lower liner of the mine, i.e. always away from the liner at the active surface of the mine.

The materials used for making the mine according to the invention are presently known. However, it is important that a selection is made among them in order to use those which will provide sufficient mechanical strength to withstand the shocks encountered during dropping of the mine. Therefore, it is preferable to use an explosive with an elastomer binder, preferably polyurethane, and to make the casing of the same material as the binder.

The mine, according to the invention, permits the efficiency of a hastily laid mine field to be doubled, especially in the case of an anti-tank mining system.

What is claimed:

1. A mine having directional effect in opposite directions comprising a casing of generally flat shape having substantially parallel upper and lower surfaces, an explosive charge secured in said casing, two spaced primer means disposed in said explosive charge, one near the upper surface and the other near the lower surface, and detonation means slidably mounted within said explosive charge for moving under the effect of gravity in a direction substantially perpendicular to the surfaces of the casing such that the detonation means will always occupy a position facing the primer means located near the lower surface whereupon detonation of the detonation means will initiate detonation of the explosive charge through the primer means located near the lower surface.

2. A mine as claimed in claim 1 comprising releasable means in said casing for holding the detonation means in an inoperative position in said explosive charge.

3. A mine as claimed in claim 1 wherein said explosive charge includes an elastomer binder and an outer envelope whose chemical composition is identical to that of the binder.

4. A mine as claimed in claim 1 wherein the casing has the shape of a truncated ellipsoid whose height-to-largest diameter ratio is a maximum of 0.7.

5. A mine as claimed in claim 1 wherein said explosive charge comprises two formed half charges symmetrically disposed with respect to a plane perpendicular to the direction of travel of the detonation means, each half charge including a metal liner proximate the respective surface of the casing.

6. A mine as claimed in claim 5 wherein said metal liners are conical.

7. A mine as claimed in claim 5 comprising a tube extending in said half charges between the liners thereof, said detonation means comprising a holder containing explosive slidably movable in said tube between the liners.

8. A mine as claimed in claim 7 wherein said holder includes a hollow portion and two explosive containing portions separated by the hollow portion.

9. A mine as claimed in claim 7 comprising an actuator means for initiating detonation of the explosive in said holder by lateral high velocity impact.

10. A mine as claimed in claim 9 wherein the actuator means comprises a self-contained influence igniter having a single pyrotechnical outlet.

* * * * *